US007743795B2

(12) United States Patent
Quigley

(10) Patent No.: US 7,743,795 B2
(45) Date of Patent: Jun. 29, 2010

(54) FORMING FABRIC HAVING BINDING WEFT YARNS

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 417 days.

(21) Appl. No.: 11/615,611

(22) Filed: Dec. 22, 2006

(65) Prior Publication Data

US 2008/0149214 A1 Jun. 26, 2008

(51) Int. Cl.
*D21F 7/08* (2006.01)
*D03D 3/04* (2006.01)
*D03D 25/00* (2006.01)

(52) U.S. Cl. ..... 139/383 A; 139/383 AA; 139/383 R; 162/358.2

(58) Field of Classification Search ..... 139/383 A, 139/383 AA; 162/358.2, 900, 902, 903
See application file for complete search history.

(56) References Cited

U.S. PATENT DOCUMENTS 3,867,766 A * 2/1975 Wagner ..... 34/95
4,224,372 A 9/1980 Romanski
4,239,065 A 12/1980 Trokhan
4,314,589 A 2/1982 Buchanan et al.
4,423,755 A 1/1984 Thompson
4,501,303 A 2/1985 Osterberg
4,564,052 A 1/1986 Borel
4,832,090 A 5/1989 Krenkel et al.
5,101,866 A 4/1992 Quigley
5,151,316 A 9/1992 Dukin et al.
5,152,326 A 10/1992 Vohringer
5,324,248 A 6/1994 Quigley
5,343,896 A * 9/1994 Schroder et al. ..... 139/383 A
5,429,686 A 7/1995 Chiu et al.
5,437,315 A 8/1995 Ward
5,456,293 A 10/1995 Ostermayer et al.
5,520,225 A 5/1996 Quigley et al.
5,542,455 A 8/1996 Ostermayer et al.
5,555,917 A * 9/1996 Quigley ..... 139/383 A
5,694,980 A 12/1997 Quigley
5,713,397 A 2/1998 Quigley
5,731,059 A 3/1998 Smith et al.
5,817,213 A 10/1998 Ostermayer et al.
5,826,627 A 10/1998 Seabrook et al.
5,840,411 A 11/1998 Stlljes et al.

(Continued)

FOREIGN PATENT DOCUMENTS

WO 02/00996 1/2002

(Continued)

OTHER PUBLICATIONS

Applicant also herein submits a co-pending U.S. Appl. No. 11/615,708.

*Primary Examiner*—Bobby H Muromoto, Jr.
(74) *Attorney, Agent, or Firm*—Greenblum & Bernstein, P.L.C.

(57) ABSTRACT

Forming fabric that includes a top layer having a plurality of top warp yarns woven with a plurality of top weft yarns. A bottom layer has a plurality of bottom warp yarns woven with a plurality of bottom weft yarns. A plurality of intrinsic binding yarns is utilized. At least one of the intrinsic binding yarns weaves with some of the top layer yarns and binds with one of the bottom layer yarns in each repeat.

32 Claims, 8 Drawing Sheets

U.S. PATENT DOCUMENTS

| | | | | |
|---|---|---|---|---|
| 5,853,547 | A | 12/1998 | Ahrens et al. | |
| 5,945,357 | A | 8/1999 | Quigley | |
| 5,967,195 | A | 10/1999 | Ward | |
| 5,988,229 | A | 11/1999 | Quigley | |
| 6,148,869 | A | 11/2000 | Quigley | |
| 6,202,705 | B1 | 3/2001 | Johnson | |
| 6,227,256 | B1 * | 5/2001 | Quigley | 139/383 A |
| 6,237,644 | B1 | 5/2001 | Hay et al. | |
| 6,349,749 | B1 | 2/2002 | Quigley | |
| 6,530,398 | B1 * | 3/2003 | Westerkamp | 139/383 A |
| 6,546,964 | B1 * | 4/2003 | Westerkamp | 139/383 A |
| 6,581,645 | B1 | 6/2003 | Johnson et al. | |
| 6,592,714 | B2 | 7/2003 | Lamb | |
| 6,649,026 | B2 | 11/2003 | Lamb | |
| 6,834,684 | B2 | 12/2004 | Martin et al. | |
| 6,860,299 | B2 | 3/2005 | Kuji | |
| 6,926,043 | B2 | 8/2005 | Quigley et al. | |
| 6,953,065 | B2 | 10/2005 | Martin et al. | |
| 6,959,737 | B2 | 11/2005 | Ward | |
| 6,978,809 | B2 | 12/2005 | Quigley | |
| 7,007,722 | B2 | 3/2006 | Quigley et al. | |
| 7,048,012 | B2 | 5/2006 | Martin et al. | |
| 7,059,357 | B2 | 6/2006 | Ward | |
| 7,059,359 | B2 | 6/2006 | Quigley et al. | |
| 2002/0056536 | A1 | 5/2002 | Lamb | |
| 2004/0020621 | A1 | 2/2004 | Heger et al. | |
| 2004/0079434 | A1 * | 4/2004 | Martin et al. | 139/383 A |
| 2004/0182465 | A1 | 9/2004 | Word | |
| 2004/0231745 | A1 * | 11/2004 | Quigley et al. | 139/383 A |
| 2004/0238062 | A1 * | 12/2004 | Quigley et al. | 139/383 A |
| 2005/0051230 | A1 * | 3/2005 | Martin et al. | 139/383 R |
| 2005/0067040 | A1 * | 3/2005 | Quigley | 139/383 A |
| 2005/0103397 | A1 * | 5/2005 | Quigley et al. | 139/383 A |
| 2005/0139281 | A1 * | 6/2005 | Martin et al. | 139/383 A |
| 2005/0167066 | A1 | 8/2005 | Herman et al. | |
| 2006/0009582 | A1 | 1/2006 | Zhang et al. | |
| 2006/0016505 | A1 * | 1/2006 | Westerkamp | 139/383 A |
| 2006/0016509 | A1 * | 1/2006 | Westerkamp et al. | 139/383 R |
| 2006/0048840 | A1 * | 3/2006 | Quigley | 139/408 |
| 2006/0060321 | A1 | 3/2006 | Quigley et al. | |
| 2006/0063451 | A1 | 3/2006 | Serr et al. | |
| 2006/0085999 | A1 | 4/2006 | Scherb et al. | |
| 2006/0219312 | A1 | 10/2006 | Hay et al. | |
| 2006/0243338 | A1 | 11/2006 | Hawes et al. | |
| 2006/0243339 | A1 | 11/2006 | Hay | |
| 2006/0278294 | A1 | 12/2006 | Quigley | |
| 2007/0006934 | A1 | 1/2007 | Quigley et al. | |
| 2007/0006935 | A1 | 1/2007 | Quigley et al. | |
| 2007/0028996 | A1 | 2/2007 | Quigley | |
| 2007/0215304 | A1 | 9/2007 | Fernandes et al. | |
| 2007/0240842 | A1 | 10/2007 | Scherb et al. | |
| 2007/0251659 | A1 | 11/2007 | Fernandes et al. | |
| 2007/0251660 | A1 | 11/2007 | Walkenhaus et al. | |
| 2007/0272385 | A1 | 11/2007 | Quigley et al. | |

FOREIGN PATENT DOCUMENTS

| | | |
|---|---|---|
| WO | 2005/014926 | 2/2005 |
| WO | 2005/035867 | 4/2005 |
| WO | 2005/075732 | 8/2005 |
| WO | 2005/075737 | 8/2005 |
| WO | 2006/113818 | 10/2006 |

* cited by examiner

Fig. 1

| | | | | | | | | | | |
|---|---|---|---|---|---|---|---|---|---|---|
| | | | X′ | B | X′ | | | X′ | X′ | 30 |
| | X′ | | A | | X′ | | X′ | X | X′ | 28 29 |
| | X′ | X′ | | | | X′ | B | X′ | | 27 |
| X′ | X | X′ | | X′ | | A | | X′ | | 25 26 |
| B | X′ | | | X′ | X′ | | | | X′ | 24 |
| | X′ | | X′ | X | X′ | | X′ | | A | 22 23 |
| | | X′ | B | X′ | | | X′ | X′ | | 21 |
| X′ | | A | | X′ | | X′ | X | X′ | | 19 20 |
| X′ | X′ | | | | X′ | B | X′ | | | 18 |
| X | X′ | | X′ | | A | | X′ | | X′ | 16 17 |
| X′ | | | X′ | X′ | | | | X′ | B | 15 |
| X′ | | X′ | X | X′ | | X′ | | A | | 13 14 |
| | X′ | B | X′ | | | X′ | X′ | | | 12 |
| | A | | X′ | | X′ | X | X′ | | X′ | 10 11 |
| X′ | | | | X′ | B | X′ | | | X′ | 9 |
| X′ | | X′ | | A | | X′ | | X′ | X | 7 8 |
| | | X′ | X′ | | | | X′ | B | X′ | 6 |
| | X′ | X | X′ | | X′ | | A | | X′ | 4 5 |
| X′ | B | X′ | | | X′ | X′ | | | | 3 |
| A | | X′ | | X′ | X | X′ | | X′ | | 1 2 |
| 1<br>2 | 3<br>4 | 5<br>6 | 7<br>8 | 9<br>10 | 11<br>12 | 13<br>14 | 15<br>16 | 17<br>18 | 19<br>20 | |

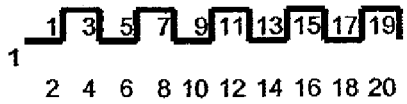
Fig. 1A
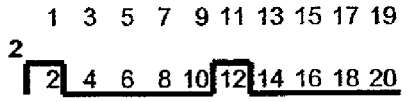
Fig. 1B
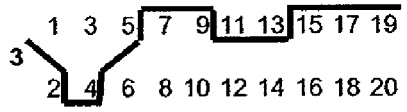
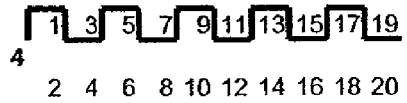
Fig. 1C
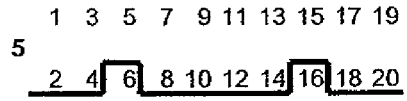
Fig. 1D
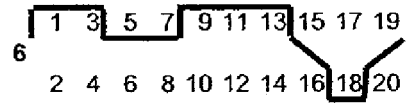
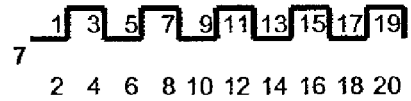
Fig. 1E
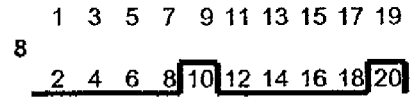
Fig. 1F
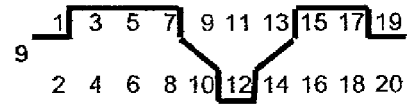
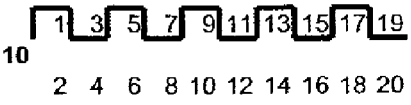
Fig. 1G
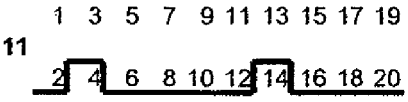

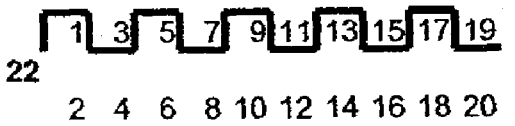
Fig. 1O
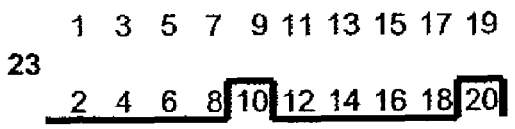
Fig. 1P
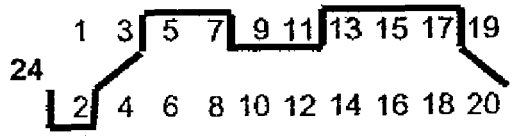
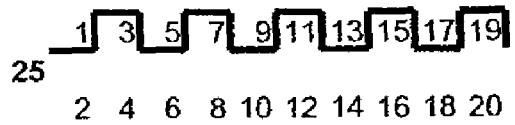
Fig. 1Q
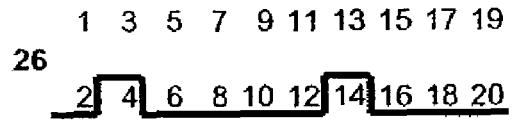
Fig. 1R
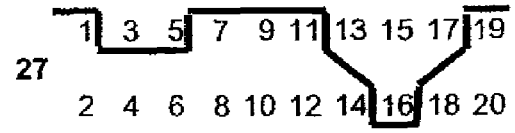
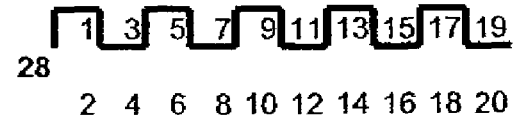
Fig. 1S
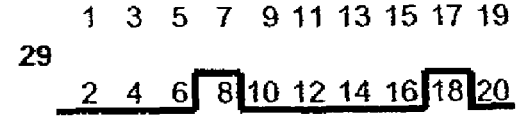
Fig. 1T
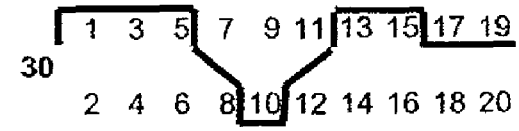

Paper Side

Wear Side

Paper Side Impression

Wear Side Impression

Paper Side

Wear Side

Paper Side Impression

Wear Side Impression

FORMING FABRIC HAVING BINDING WEFT YARNS

BACKGROUND OF THE INVENTION

1. Field of the Invention

The present invention relates generally to papermaking, and relates more specifically to multilayer fabrics employed in papermaking. The invention also relates to the binding of triple layer forming fabrics with weft yarns. The present invention also relates to multilayer papermaker's fabrics that employ weave patterns which can provide one or more of the following advantages: impart a disturbed and/or textured surface onto the paper; produce an improved three-dimensional formation of the paper sheet; produce an improved textured board or packaging paper 2. Discussion of Background Information In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

U.S. Pat. No. 5,152,326 to VOHRINGER, the disclosure of which is hereby expressly incorporated by reference in its entirety, discloses a composite papermaking fabric including an upper fabric upon which a fiber suspension will be deposited for producing paper and a lower fabric or running surface being driven by the papermaking machine. The upper and lower fabrics are connected by binding threads. Use of separate, independent binding threads or binding threads which are only a part of the upper layer is replaced by the interweaving of fabric-born threads which are an integral part of the lower fabric and fabric-born threads which are an integral part of the upper fabric. Relative slippage between the upper and lower fabric layers is eliminated or decreased and the strength of the connection is increased. The marking of the paper is decreased. The fabric-born threads of one fabric layer cross the fabric-born threads of the other after at least one length of weave pattern. VOHRINGER, however, utilizes a plain weave and vertically stacked pairs of intrinsic binders. Furthermore, the fabric of VOHRINGER is designed with a smooth surface, i.e., it utilizes a plain weave which is undisturbed and/or untextured, so as to impart this type of surface to the paper. That is, the fabric is not utilized to provide texturing to the paper. Finally, the binders in VOHRINGER are not designed to float over any crossing yarns and do not extend above a main paper side surface (as defined by an upper surface of the non-binding yarns) of the fabric and are not utilized to impart surface impressions into the paper surface, i.e., to produce a disturbed or textured surface on the paper.

U.S. Pat. No. 5,826,627 to SEABROOK et al., the disclosure of which is hereby expressly incorporated by reference in its entirety, discloses a composite forming fabric in which the woven paper and machine side layers are interconnected by pairs of intrinsic weft binder yarns which interweave with the paper side layer to occupy an unbroken weft path. Each member interweaves sequentially with the warps of the paper side layer and with at least one warp of the machine side layer. Each part of the unbroken weft path is separated from adjacent parts by at least one paper side layer warp yarn. The unbroken weft path is the same, or different, to the weft path of the immediately adjacent paper side layer weft yarns. This arrangement overcomes the paper side layer surface imperfections, which cause an unacceptable level of marking, hitherto associated with the use of additional weft binder yarns in composite fabrics. SEABROOK, however, also utilizes a plain weave and vertically stacked pairs of intrinsic weft binders. Furthermore, the fabric of SEABROOK is designed with a smooth surface, i.e., it utilizes a plain weave which is undisturbed and/or untextured, so as to impart this type of surface to the paper. That is, the fabric is not utilized to provide texturing to the paper. Finally, the weft binders in SEABROOK are not designed to float over any crossing yarns and do not extend above a main paper side surface (as defined by an upper surface of the non-binding yarns) of the fabric and are not utilized to impart surface impressions into the paper surface, i.e., to produce a disturbed or textured surface on the paper.

U.S. Pat. No. 5,967,195 to WARD, the disclosure of which is hereby expressly incorporated by reference in its entirety, discloses a multi-layer papermaker's forming fabric has stitching yarns integrated into the papermaking surface. Each of a plurality of repeating units of the fabric comprises: a set of top machine direction yarns; a set of top cross-machine direction yarns interwoven with the top machine direction yarns; a set of bottom machine direction yarns; a set of bottom cross-machine direction yarns interwoven with the bottom machine direction yarns; and pairs of first and second stitching yarns. The stitching yarn pairs are positioned between pairs of top cross-machine direction yarns. The stitching yarns of each pair are interwoven with the top and bottom machine direction yarns such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first stitching yarn is positioned below the top machine direction yarns. The first and second stitching yarns cross each other as they pass below a transitional top machine direction yarn. Also, each of the binding portions of the first and second stitching yarns passes below at least one of the bottom machine direction yarns. In this configuration, the stitching yarns are completely integrated into the top, or papermaking, surface of the fabric, and therefore do not adversely impact the papermaking qualities of the fabric. WARD, however, utilizes vertically stacked pairs of intrinsic weft binders. Furthermore, the fabric of WARD is apparently not designed to produce disturbed and/or textured surface onto the paper. That is, the fabric does not appear to provide texturing to the paper. Finally, the weft binders in WARD do not extend above a main paper side surface (as defined by an upper surface of the non-binding yarns) of the fabric and are not utilized to impart surface impressions into the paper surface, i.e., to produce a disturbed or textured surface on the paper.

SUMMARY OF THE INVENTION

The present invention relates to multilayer papermaker's fabrics that employ weave patterns which can provide one or more of the following advantages: impart a disturbed and/or textured surface onto the paper; produce an improved three-dimensional formation of the paper sheet; produce an improved textured board or packaging paper. The paper sheet formed with the forming fabric may have added bulk and/or may have more fibers oriented in the z-direction so as to improve strength, and in particular, improved crush resistance.

The present invention relates to multilayer papermaker's fabrics that are warp-stitched or weft-stitched.

The present invention relates to multilayer papermaker's fabrics that are preferably weft-stitched.

The present invention relates to multilayer papermaker's fabrics that are preferably weft-stitched with single weft binder yarns.

The present invention relates to multilayer papermaker's fabrics that are preferably weft-stitched with single weft binder yarns which float over two or more warp yarns in the upper layer.

The present invention relates to multilayer papermaker's fabrics that are preferably weft-stitched with single weft binder yarns which float over two or more warp yarns in the upper layer, wherein the binders impart a disturbed and/or a textured surface to the paper.

The present invention relates to multilayer papermaker's fabrics that are preferably weft-stitched with single weft binder yarns which float over two or more warp yarns in the upper layer, wherein the binders extend above a main paper side surface (as defined by an upper surface of the non-binding yarns) of the fabric so as to impart surface impressions into the paper surface, i.e., to produce a disturbed or textured surface on the paper.

The present invention relates to multilayer papermaker's fabrics that are preferably weft-stitched with single weft binder yarns that extend above a main paper side surface by between approximately 0.01 mm and approximately 5 mm, and is preferably between approximately 0.1 mm and approximately 0.5 mm.

By way of non-limiting example, the present invention provides for a forming fabric which utilizes a single intrinsic weft binder to bind upper and lower layers of a triple layer forming fabric.

By way of non-limiting example, the present invention provides for a forming fabric which utilizes weft binders to impart a disturbed and/or a textured surface to the surface to the paper being formed and which bind with only one warp yarn in the lower layer in each pattern repeat.

By way of non-limiting example, the present invention provides for a forming fabric which utilizes weft binders to impart a disturbed and/or a textured by float over crossing upper layer warp yarns with 2-over/2-under/3-over weave and which extend above a main paper side surface (as defined by an upper surface of the non-binding yarns) of the fabric so as to impart surface impressions into the paper surface, i.e., to produce a disturbed or textured surface on the paper.

By way of non-limiting example, the present invention provides for a forming fabric which utilizes weft binders to impart a disturbed and/or a textured by float over crossing upper layer warp yarns with 3-over/1-under/3-over weave in each pattern repeat and which extend above a main paper side surface (as defined by an upper surface of the non-binding yarns) of the fabric so as to impart surface impressions into the paper surface, i.e., to produce a disturbed or textured surface on the paper.

According to another non-limiting embodiment of the present invention, the weft-stitched triple layer papermaker's fabric may utilize non-binding weft yarns which are woven with a plain weave on the top fabric.

According to another non-limiting embodiment of the present invention, each binding or stitching weft yarn is a fabric-borne or intrinsic yarn.

According to another non-limiting embodiment of the present invention, the weft-stitched triple layer papermaker's fabric utilizes binding weft floats to produce impressions in the paper.

According to another non-limiting embodiment of the present invention, the bottom warp yarns are larger than the top warp yarns, and are preferably significantly larger than the top warp yarns.

According to another non-limiting embodiment of the present invention, the bottom weft yarns are larger than the top weft yarns, and are preferably significantly larger than the top weft yarns.

According to another non-limiting embodiment of the present invention, the bottom warp yarns are approximately 0.40 mm in diameter and the top warp yarns are approximately 0.20 mm in diameter.

According to another non-limiting embodiment of the present invention, the binding weft yarns are approximately 0.20 mm in diameter.

According to another non-limiting embodiment of the present invention, a size ratio of the bottom warp yarns relative to the top warp yarns is in the range of between approximately 1.5 to 1 and approximately 2 to 1, and is preferably between approximately 1.25 to 1 and approximately 2.25 to 1.

In additional aspects of the present invention, the forming fabric may include single stitching weft yarns. The stitching weft yarns may have a larger diameter than the top non-binding weft yarns. The top weft non-binding yarns may also have substantially the same diameter as the bottom weft yarns. The top weft yarns may have a smaller diameter than the bottom weft yarns. Additionally, the non-binging weft yarns of the papermaking surface may be woven in a plain weave pattern. The machine side surface may be woven such that in each repeat unit of the fabric, each stitching warp yarn binds with only a single bottom warp yarn in a pattern repeat. The stitching warp yarns may also be alternately arranged such that between each two non-adjacent stacked upper and lower weft yarns of the top and bottom fabrics is located a single binding weft yarn which weaves with the top warp yarns and binds with a single bottom warp yarn. Additionally, in embodiments, the binding weft yarn may pass or float over five or six top warp yarns in each repeat of the fabric. Furthermore, in embodiments, the weft binding yarn may cross over (i.e., float over) two pairs of top warp yarns in each repeat of the fabric. In embodiments, the weft binding yarn may cross over (i.e., float over) two top warp yarns and then three other top warp yarns in each repeat of the fabric. In embodiments, the weft binding yarn may cross over (i.e., float over) three top warp yarns and then three other top warp yarns in each repeat of the fabric.

The invention also provides for a forming fabric comprising a top layer comprising a plurality of top warp yarns woven with a plurality of top weft yarns, a bottom layer comprising a plurality of bottom warp yarns woven with a plurality of bottom weft yarns, a plurality of intrinsic binding yarns, and at least one of the intrinsic binding yarns weaving with some of the top layer yarns and binding with one of the bottom layer yarns in each repeat.

The plurality of intrinsic binding yarns may be binding weft yarns weaving to in the top layer with a different weave pattern than the plurality of top weft yarns. The plurality of intrinsic binding yarns may be binding warp yarns weaving to in the top layer with a different weave pattern than the plurality of top warp yarns. The plurality of intrinsic binding yarns may weave to in top layer with a different weave pattern than the plurality of top weft yarns and the plurality of top warp yarns. The forming fabric may be a weft-stitched triple layer papermaker's fabric. The forming fabric is a warp-stitched triple layer papermaker's fabric. The top layer may have a papermaking surface and the bottom layer may have a machine side surface. The plurality of weft yarns in the top layer may weave to the top layer warp yarns with a plain weave. Each of the plurality of second top warp yarns and each of the plurality of second bottom warp yarns may weave to the bottom layer with a short plain weave. The at least one of the intrinsic binding yarn may bind with only one of the bottom layer yarns in each repeat. The at least one of the intrinsic binding yarn may bind with only one of the plurality of the bottom layer warp yarns in each repeat. Each intrinsic binding yarn may bind with only one of the plurality of the bottom layer warp yarns in each repeat.

The plurality of top warp yarns and the plurality of bottom warp yarns may be vertically stacked. The plurality of top weft yarns and the plurality of bottom weft yarns may be vertically stacked. The intrinsic binding yarns may differ from the plurality of the top layer warp and weft yarns in at least one of the following characteristics: size; modulus; and material. At least one of the plurality of top warp yarns may differ from at least one of the plurality of bottom warp yarns in at least one of the following characteristics: size; modulus; and material. The at least one of the plurality of top weft yarns may differ from the at least one of the plurality of bottom weft yarns in at least one of the following characteristics: size; modulus; and material. At least one of the plurality of top warp yarns may be smaller in size than at least one of the plurality of bottom warp yarns. The top layer weft and warp yarns may be woven with a plain weave and the intrinsic binding yarns may weave in the top layer with a textured weave pattern. The top layer weft and warp yarns may be woven with a plain weave and the intrinsic binding yarns may be binding weft yarns which weave with top layer warp yarns with a textured weave pattern. The top layer weft and warp yarns may be woven with a plain weave and the intrinsic binding yarns may be binding warp yarns which weave with top layer weft yarns with a textured weave pattern.

The intrinsic binding yarns may be structured and arranged to impart a disturbed and/or a textured surface onto paper by floating over crossing upper layer yarns with 2-over/2-under/3-over weave. The intrinsic binding yarns may be structured and arranged to impart a disturbed and/or a textured surface onto paper by floating over crossing upper layer yarns with 3-over/1-under/3-over weave. The intrinsic binding yarns may be structured and arranged to extend above a main paper side surface of the fabric so as to impart surface impressions into a surface of paper. Every other pick may be a single intrinsic binding yarn which weaves with some of the top layer yarns and binds with one of the bottom layer yarns in each repeat.

The invention also provides for a forming fabric comprising a top layer comprising a plurality of top warp yarns woven with a plurality of top weft yarns, a bottom layer comprising a plurality of bottom warp yarns woven with a plurality of bottom weft yarns, a plurality of binding weft yarns, and at least one of the binding weft yarns weaving with some of the top layer yarns and binding with one of the bottom layer yarns in each repeat.

The plurality of binding weft yarns may be intrinsic binding weft yarns that weave to in the top layer with a different weave pattern than the plurality of top weft yarns.

The invention also provides for a forming fabric comprising a top layer comprising a plurality of top warp yarns woven with a plurality of top weft yarns and a bottom layer comprising a plurality of bottom warp yarns woven with a plurality of bottom weft yarns, wherein the top layer is bound to the bottom layer with single binding yarns which weave with some of the top layer yarns and bind with one of the bottom layer yarns in each repeat.

The single binding yarns may be single binding weft yarns which weave with some of the top layer warp yarns and bind with one of the bottom layer warp yarns in each repeat. The single binding yarns may be intrinsic binding weft yarns which weave to in the top layer with a different weave pattern than the plurality of top weft yarns.

The invention also provides for a method of making the fabric of the type described above, wherein the method comprises binding together the top and bottom layers with the single binding yarns.

The invention also provides for a method of making the fabric of the type described above, wherein the method comprises binding together the top and bottom layers with the at least one of the plurality of intrinsic binding yarns.

The invention also provides for a method of making the fabric of the type described above, wherein the method comprises binding together the top and bottom layers with the at least one of the plurality of binding weft yarns.

Additional aspects of the present invention include methods of manufacturing warp-stitched triple layer fabrics and methods of using the triple layer papermaker's fabric described herein for making paper.

BRIEF DESCRIPTION OF THE FIGURES

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 shows a textured weave pattern repeat of a first embodiment of the present invention;

FIG. 1A shows a cross-section view of the repeat shown in FIG. 1 and illustrates upper and lower weft yarns 1 and 2 respectively weaving with upper and lower fabric warp yarns 1-20. Weft yarn 1 weaves exclusively in the top fabric layer and weft yarn 2 weaves exclusively in the bottom fabric layer;

FIG. 1B shows a cross-section view of the repeat shown in FIG. 1 and illustrates a single binding weft yarn 3 which weaves with the upper fabric warp yarns and which binds with one of the warp yarns of the lower fabric layer;

FIG. 1C shows a cross-section view of the repeat shown in FIG. 1 and illustrates another upper and lower weft yarns 4 and 5 respectively weaving with upper and lower fabric warp yarns 1-20. Weft yarn 4 weaves exclusively in the top fabric layer and weft yarn 5 weaves exclusively in the bottom fabric layer;

FIG. 1D shows a cross-section view of the repeat shown in FIG. 1 and illustrates another single binding weft yarn 6 which weaves with the upper fabric warp yarns and which binds with one of the warp yarns of the lower fabric layer;

FIG. 1E shows a cross-section view of the repeat shown in FIG. 1 and illustrates another upper and lower weft yarns 7 and 8 respectively weaving with upper and lower fabric warp yarns 1-20. Weft yarn 7 weaves exclusively in the top fabric layer and weft yarn 8 weaves exclusively in the bottom fabric layer;

FIG. 1F shows a cross-section view of the repeat shown in FIG. 1 and illustrates another single binding weft yarn 9 which weaves with the upper fabric warp yarns and which binds with one of the warp yarns of the lower fabric layer;

FIG. 1G shows a cross-section view of the repeat shown in FIG. 1 and illustrates another upper and lower weft yarns 10 and 11 respectively weaving with upper and lower fabric warp yarns 1-20. Weft yarn 10 weaves exclusively in the top fabric layer and weft yarn 11 weaves exclusively in the bottom fabric layer;

FIG. 1O shows a cross-section view of the repeat shown in FIG. 1 and illustrates another upper and lower weft yarns 22 and 23 respectively weaving with upper and lower fabric warp yarns 1-20. Weft yarn 22 weaves exclusively in the top fabric layer and weft yarn 23 weaves exclusively in the bottom fabric layer;

FIG. 1P shows a cross-section view of the repeat shown in FIG. 1 and illustrates another single binding weft yarn 24 which weaves with the upper fabric warp yarns and which binds with one of the warp yarns of the lower fabric layer;

FIG. 1Q shows a cross-section view of the repeat shown in FIG. 1 and illustrates another upper and lower weft yarns 25 and 26 respectively weaving with upper and lower fabric warp yarns 1-20. Weft yarn 25 weaves exclusively in the top fabric layer and weft yarn 26 weaves exclusively in the bottom fabric layer;

FIG. 1R shows a cross-section view of the repeat shown in FIG. 1 and illustrates another single binding weft yarn 27 which weaves with the upper fabric warp yarns and which binds with one of the warp yarns of the lower fabric layer;

FIG. 1S shows a cross-section view of the repeat shown in FIG. 1 and illustrates another upper and lower weft yarns 28 and 29 respectively weaving with upper and lower fabric warp yarns 1-20. Weft yarn 28 weaves exclusively in the top fabric layer and weft yarn 29 weaves exclusively in the bottom fabric layer;

FIG. 1T shows a cross-section view of the repeat shown in FIG. 1 and illustrates another single binding weft yarn 30 which weaves with the upper fabric warp yarns and which binds with one of the warp yarns of the lower fabric layer;

DETAILED DESCRIPTION OF THE INVENTION

Figure 1H:
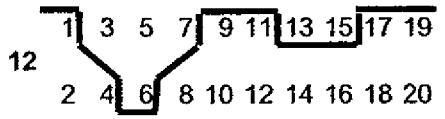
FIG. 1H shows a cross-section view of the repeat shown in FIG. 1 and illustrates another single binding weft yarn 12 which weaves with the upper fabric warp yarns and which binds with one of the warp yarns of the lower fabric layer.
Figure 1H:
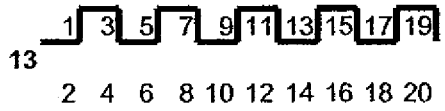

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

One aspect of the present invention is directed to "true" weft-stitched triple layer papermaker's fabrics in that they include a set of warp yarns and a set of weft yarns that only weave in the top layer of the fabric, as well as a set of warp yarns and a set of weft yarns that only weave in the bottom fabric layer. These fabrics also include stitching warp yarns that weave in the top fabric layer and bind to the bottom fabric layer to bind the layers together. In certain embodiments of the present invention, the binding or stitching weft yarns are provided as single stitching yarns that replace the equivalent of two weft yarns in the weave pattern on the papermaking surface. These yarns are woven such that each binding yarn weaves in the top fabric layer so as to provide a weave pattern on the papermaking surface and binds on one of the warp yarns in the mower fabric layer. Throughout the fabric, the binding yarns move between the upper and lower layers. Each binding yarn drops down to the bottom fabric layer at one point (binding with one bottom layer warp yarns) in each repeat so as to bind the top and bottom fabric layers together. Herein, the binding weft yarn is referred to as a "stitching or binding weft yarn."

In certain embodiments of the invention, the "true" weft-stitched triple layer papermaker's fabrics are woven from three separate warp beams. As will be appreciated by those of skill in the art, in manufacturing papermaker's fabrics using a flat weaving process, the warp yarns are fed into the loom off of one or more warp yarn beams (or "warp beams") and the weft yarns or "picks" are "thrown" one-by-one by the loom so that they pass in the desired over/under pattern with respect to the warp yarns to weave the fabric. The tension on the yarns in each warp beam may be independently controlled, and the types of yarns provided on each beam (e.g., yarn size, modulus, filament type, etc.) may be varied. By weaving the weft-stitched fabrics of the present invention off of three separate weft beams, at least two distinct advantages may accrue.

First, by using three separate warp beams, it is possible to vary the size and/or type of yarn used for (1) the top warp yarns, (2) the bottom warp yarns and (3) the stitching warp yarns. This may be advantageous because the requirements for yarns that weave in the top layer versus the bottom layer versus both layers may differ. By way of example, in many applications, it may be desirable to use larger, sturdier warp yarns in the bottom fabric layer to provide good stretch resistance and stability. In contrast, finely woven warp yarns are often preferred on the papermaking surface as such yarns may facilitate providing a highly uniform surface that exhibits good drainage while providing a high degree of fiber support. The stitching warp yarns may have their own unique requirements. Through the use of three separate warp beams, the fabric designer can optimize the type and sizes of yarns used for the yarns that weave in different parts of the fabric. Second, the use of a separate weft beam for the top, bottom and stitching warp yarns also allows for independent tension control on each type of warp yarn. This tension control may also be used to increase the uniformity of the papermaking surface as variations in tension may impact the degree of the crimp that each type of yarn exhibits on the papermaking surface.

Pursuant to another aspect of the present invention, multi-layer weft-stitched papermaker's fabrics are provided which include stitching weft yarns that are single binding yarns. This aspect of the present invention is best explained with reference to FIGS. 1A-1T, which are cross-sectional views of a portion of a representative fabric that show the configuration of the weft yarns in the fabric.

FIG. 1 depicts a top pattern view of the top fabric layer of the triple layer fabric (i.e., a view of the papermaking surface). The numbers 1-20 shown on the bottom of the pattern identify the upper and lower warp yarns while the right side numbers 1-30 show the upper and lower weft yarns and the binding weft yarns. The upper warp yarns shown on the bottom of the pattern are 1, 3, 5, 7, 9, 11, 13, 15, 17 and 19. The lower warp yarns shown on the bottom of the pattern are 2, 4, 6, 8, 10, 12, 14, 16, 18 and 20. The upper weft yarns shown on the right side of the pattern are 1, 4, 7, 10, 13, 16, 19, 22, 25 and 28. The lower weft yarns shown on the right side of the pattern are 2, 5, 8, 11, 14, 17, 20, 23, 26 and 29. Weft yarns 3, 6, 9, 12, 15, 18, 21, 24, 27 and 30 constitute the single stitching or binding weft yarns. Upper weft yarns 1, 4, 7, 10, 13, 16, 19, 22, 25 and 28 weave exclusively with the upper layer warp yarns 1, 3, 5, 7, 9, 11, 13, 15, 17 and 19, and lower weft yarns 2, 5, 8, 11, 14, 17, 20, 23, 26 and 29 weave exclusively with the lower layer warp yarns 2, 4, 6, 8, 10, 12, 14, 16, 18 and 20.

Also in FIG. 1, symbol A is shown in locations where both upper and lower warp yarns are not passed under by any weft yarns. Symbol B is shown in locations where a binding weft yarn passes under or binds with a bottom layer warp yarn. Symbol X is shown in locations where an exclusively upper layer weft yarn passes over an upper layer warp yarn while an exclusively lower layer weft yarn passes over a lower layer warp yarn arranged directly beneath the upper layer warp yarn. Symbol X' is shown in locations where an exclusively upper layer weft yarn passes under an upper layer warp yarn while an exclusively lower layer weft yarn passes under a lower layer warp yarn arranged directly beneath the upper layer warp yarn.

FIGS. 1A-1T depict the paths of the upper and lower weft yarns and binding yarns 1-30 through the upper and lower warp yarns 1-20. The triple layer fabric of FIG. 1 thus shows a single repeat of the fabric that encompasses 30 weft yarns (yarns 1-30 represented vertically in the figures) and 20 warp yarns (yarns 1-20 represented horizontally in the figures). While FIGS. 1-1T only show a single repeat unit of the fabric, those of skill in the art will appreciate that in commercial applications the repeat unit shown in FIGS. 1-1T would be repeated many times, in both the warp and weft directions, to form a large fabric suitable for use on a papermaking machine.

As seen in FIG. 1A, an upper weft yarn 1 that weaves exclusively with the top layer warp yarns 1, 3, 5, 7, 9, 11, 13, 15, 17 and 19 to form a plain weave.

Also seen in FIG. 1A, a lower weft yarn 2 weaves exclusively with the bottom layer warp yarns 2, 4, 6, 8, 10, 12, 14, 16, 18 and 20 to form a pattern which follows the following course: lower weft yarn 2 passes over lower warp yarn 2, then passes or floats under warp yarns 4, 6, 8 and 10, then passes over lower warp yarn 12, then passes or floats under lower warp yarns 14, 16, 18 and 20.

As seen in FIG. 1B, a single stitching or binding weft yarn 3 passes under upper warp yarn 1, and crosses to the lower layer by binding with lower warp yarn 4. That is, the binding weft yarn 3 binds only with lower warp yarn 4. Thus, in the area where the stitching or binding weft yarn 3 binds with the lower layer, the binding of the lower layer occurs with a single binding point per repeat. Thereafter, the stitching or binding weft yarn 3 crosses back over to the upper layer by passing underneath upper warp yarn 5 before weaving with other upper warp yarns. The stitching or binding weft yarn 3 passes or floats over upper warp yarns 7 and 9, then passes under upper warp yarns 11 and 13, then passes or floats over upper warp yarns 15, 17 and 19.

As seen in FIG. 1C, another upper weft yarn 4 that weaves exclusively with the top layer warp yarns 1, 3, 5, 7, 9, 11, 13, 15, 17 and 19 to form a plain weave.

Also seen in FIG. 1C, another lower weft yarn 5 weaves exclusively with the bottom layer warp yarns 2, 4, 6, 8, 10, 12, 14, 16, 18 and 20 to form a pattern which follows the following course: lower weft yarn 5 passes or floats under lower warp yarns 2 and 4, then passes over warp yarn 6, then passes or floats under lower warp yarns 8, 10, 12 and 14, then passes over lower warp yarn 16, and then floats under lower warp yarns 18 and 20.

As seen in FIG. 1D, another single stitching or binding weft yarn 6 passes or floats over upper warp yarns 1 and 3, then passes under upper warp yarns 5 and 7, and then passes or floats over upper warp yarns 9, 11 and 13. Then, the single stitching or binding weft yarn 6 crosses to the lower layer by passing under upper warp yarn 15 and then binding with lower warp yarn 18. That is, the binding weft yarn 6 binds only with lower warp yarn 18. Thus, in the area where the stitching or binding weft yarn 6 binds with the lower layer, the binding of the lower layer occurs with a single binding point per repeat. Thereafter, the stitching or binding weft yarn 6 crosses back over to the upper layer by passing underneath upper warp yarn 19 before weaving with other upper warp yarns in another pattern repeat.

As seen in FIG. 1E, another upper weft yarn 7 that weaves exclusively with the top layer warp yarns 1, 3, 5, 7, 9, 11, 13, 15, 17 and 19 to form a plain weave.

Also seen in FIG. 1E, another lower weft yarn 8 weaves exclusively with the bottom layer warp yarns 2, 4, 6, 8, 10, 12, 14, 16, 18 and 20 to form a pattern which follows the following course: lower weft yarn 8 passes or floats under lower warp yarns 2, 4, 6 and 8, then passes over warp yarn 10, then passes or floats under lower warp yarns 12, 14, 16 and 18, then passes over lower warp yarn 20.

As seen in FIG. 1F, another single stitching or binding weft yarn 9 passes under upper warp yarn 1, then passes or floats over upper warp yarns 3, 5 and 7. The stitching or binding weft yarn 9 then crosses to the lower layer by passing under upper warp yarn 9 and then binds with lower warp yarn 12. That is, the binding weft yarn 9 binds only with lower warp yarn 12. Thus, in the area where the stitching or binding weft yarn 9 binds with the lower layer, the binding of the lower layer occurs with a single binding point per repeat. Thereafter, the stitching or binding weft yarn 9 crosses back over to the upper layer by passing underneath upper warp yarn 13 before weaving with other upper warp yarns by passing or floating over upper warp yarns 15 and 17, and then passes under upper warp yarn 19.

As seen in FIG. 1G, another upper weft yarn 10 that weaves exclusively with the top layer warp yarns 1, 3, 5, 7, 9, 11, 13, 15, 17 and 19 to form a plain weave.

Also seen in FIG. 1G, another lower weft yarn 11 weaves exclusively with the bottom layer warp yarns 2, 4, 6, 8, 10, 12, 14, 16, 18 and 20 to form a pattern which follows the following course: lower weft yarn 11 passes under lower warp yarn 2, then passes over warp yarn 4, then passes or floats under lower warp yarns 6, 8, 10 and 12, then passes over lower warp yarn 14. Thereafter, lower weft yarn 11 passes or floats under lower warp yarns 16, 18 and 20.

As seen in FIG. 1H, another single stitching or binding weft yarn 12 passes over upper warp yarn 1. The stitching or binding weft yarn 12 then crosses to the lower layer by passing under upper warp yarn 3 and then binds with lower warp yarn 6. That is, the binding weft yarn 12 binds only with lower warp yarn 6. Thus, in the area where the stitching or binding weft yarn 12 binds with the lower layer, the binding of the lower layer occurs with a single binding point per repeat. Thereafter, the stitching or binding weft yarn 12 crosses back over to the upper layer by passing underneath upper warp yarn 7 before weaving with other upper warp yarns by passing or floating over upper warp yarns 9 and 11, then passing under upper warp yarns 13 and 15, and then passing or floating over upper warp yarns 17 and 19.

Figure 1I:
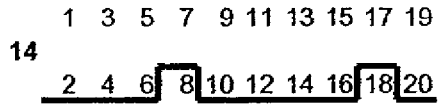
FIG. 1I shows a cross-section view of the repeat shown in FIG. 1 and illustrates another upper and lower weft yarns 13 and 14 respectively weaving with upper and lower fabric warp yarns 1-20. Weft yarn 13 weaves exclusively in the top fabric layer and weft yarn 14 weaves exclusively in the bottom fabric layer.

As seen in FIG. 1I, another upper weft yarn 13 that weaves exclusively with the top layer warp yarns 1, 3, 5, 7, 9, 11, 13, 15, 17 and 19 to form a plain weave.

Also seen in FIG. 1I, another lower weft yarn 14 weaves exclusively with the bottom layer warp yarns 2, 4, 6, 8, 10, 12, 14, 16, 18 and 20 to form a pattern which follows the following course: lower weft yarn 14 passes or floats under lower warp yarns 2, 4 and 6, then passes over warp yarn 8, then passes or floats under lower warp yarns 10, 12, 14 and 16, then passes over lower warp yarn 18, before passing under lower warp yarns 20.

Figure 1J:
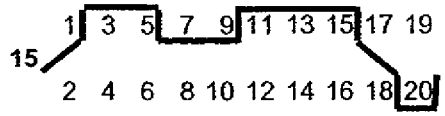
FIG. 1J shows a cross-section view of the repeat shown in FIG. 1 and illustrates another single binding weft yarn 15 which weaves with the upper fabric warp yarns and which binds with one of the warp yarns of the lower fabric layer.
Figure 1J:
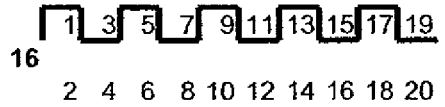

As seen in FIG. 1J, another single stitching or binding weft yarn 15 passes under upper warp yarn 1, then passes or floats over upper warp yarns 3 and 5. The stitching or binding weft yarn 15 then passes under upper warp yarns 7 and 9 and then passes or floats over upper warp yarns 11, 13 and 15. The stitching or binding weft yarn 15 then crosses to the lower layer by passing under upper warp yarn 17 and then binds with lower warp yarn 20. That is, the binding weft yarn 15 binds only with lower warp yarn 20. Thus, in the area where the stitching or binding weft yarn 15 binds with the lower layer, the binding of the lower layer occurs with a single binding point per repeat. Thereafter, the stitching or binding weft yarn 15 crosses back over to the upper layer before weaving with other upper warp yarns of another repeat.

Figure 1K:
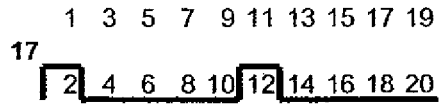
FIG. 1K shows a cross-section view of the repeat shown in FIG. 1 and illustrates another upper and lower weft yarns 16 and 17 respectively weaving with upper and lower fabric warp yarns 1-20. Weft yarn 16 weaves exclusively in the top fabric layer and weft yarn 17 weaves exclusively in the bottom fabric layer.

As seen in FIG. 1K, another upper weft yarn 16 that weaves exclusively with the top layer warp yarns 1, 3, 5, 7, 9, 11, 13, 15, 17 and 19 to form a plain weave.

Also seen in FIG. 1K, another lower weft yarn 17 weaves exclusively with the bottom layer warp yarns 2, 4, 6, 8, 10, 12, 14, 16, 18 and 20 to form a pattern which follows the following course: lower weft yarn 17 passes over lower warp yarn 2, then passes or floats under lower warp yarns 4, 6, 8 and 10, then passes over lower warp yarn 12. Thereafter, lower weft yarn 17 passes or floats under lower warp yarns 14, 16, 18 and 20.

Figure 1L:
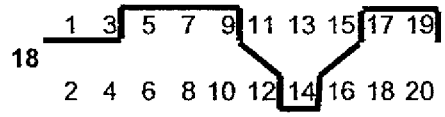
FIG. 1L shows a cross-section view of the repeat shown in FIG. 1 and illustrates another single binding weft yarn 18 which weaves with the upper fabric warp yarns and which binds with one of the warp yarns of the lower fabric layer.
Figure 1L:
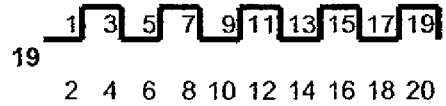

As seen in FIG. 1L, another single stitching or binding weft yarn 18 passes under upper warp yarns 1 and 3. The stitching or binding weft yarn 18 then passes or floats over upper warp yarns 5, 7 and 9. The stitching or binding weft yarn 18 then crosses to the lower layer by passing under upper warp yarn 11 and then binds with lower warp yarn 14. That is, the binding weft yarn 18 binds only with lower warp yarn 14. Thus, in the area where the stitching or binding weft yarn 18 binds with the lower layer, the binding of the lower layer occurs with a single binding point per repeat. Thereafter, the stitching or binding weft yarn 18 crosses back over to the upper layer by passing underneath upper warp yarn 15 before weaving with other upper warp yarns by passing or floating over upper warp yarns 17 and 19.

Figure 1M:
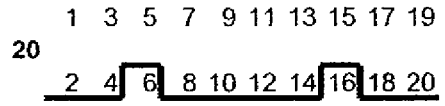
FIG. 1M shows a cross-section view of the repeat shown in FIG. 1 and illustrates another upper and lower weft yarns 19 and 20 respectively weaving with upper and lower fabric warp yarns 1-20. Weft yarn 19 weaves exclusively in the top fabric layer and weft yarn 20 weaves exclusively in the bottom fabric layer.

As seen in FIG. 1M, another upper weft yarn 19 that weaves exclusively with the top layer warp yarns 1, 3, 5, 7, 9, 11, 13, 15, 17 and 19 to form a plain weave.

Also seen in FIG. 1M, another lower weft yarn 20 weaves exclusively with the bottom layer warp yarns 2, 4, 6, 8, 10, 12, 14, 16, 18 and 20 to form a pattern which follows the following course: lower weft yarn 20 passes under lower warp yarns 2 and 4, then passes over warp yarn 6, then passes or floats under lower warp yarns 8, 10, 12 and 14, then passes over lower warp yarn 16. Thereafter, lower weft yarn 20 passes or floats under lower warp yarns 18 and 20.

Figure 1N:
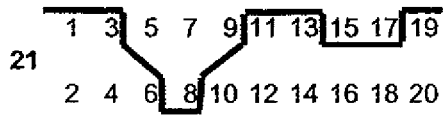
FIG. 1N shows a cross-section view of the repeat shown in FIG. 1 and illustrates another single binding weft yarn 21 which weaves with the upper fabric warp yarns and which binds with one of the warp yarns of the lower fabric layer.
Figure 2A:
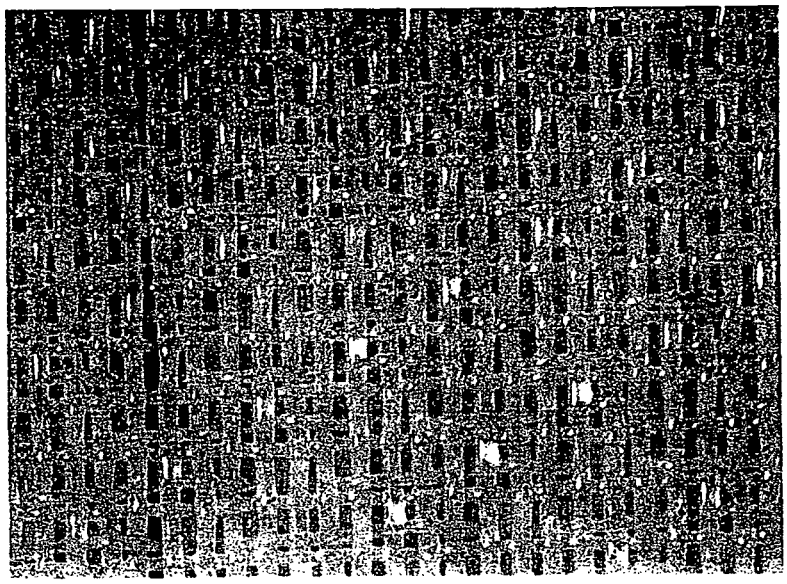
FIG. 2A shows a top view of an actual forming fabric having one or more features of the invention and illustrates the weave of the paper side of the forming fabric. This figure uses a 2-over/2-under/3-over binder weave pattern.
Figure 2B:
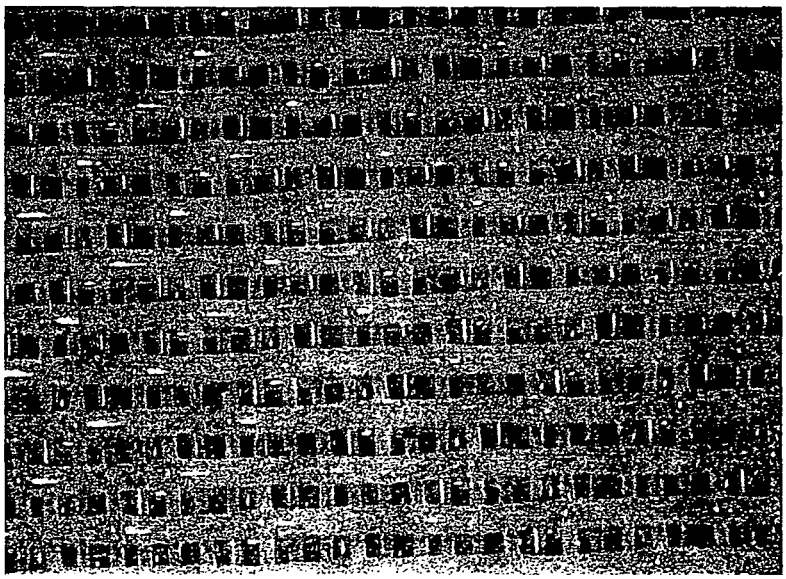
FIG. 2B a bottom view of an actual forming fabric having one or more features of the invention and illustrates the weave of the machine side of the forming fabric shown in FIG. 2A.
Figure 3A:
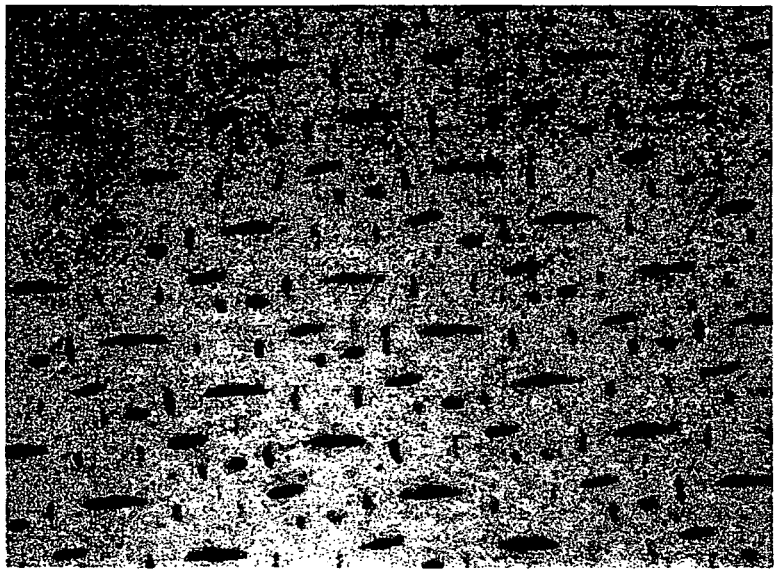
FIG. 3A shows the impressions which would be formed by the forming fabric surface shown in FIG. 2A.
Figure 3B:
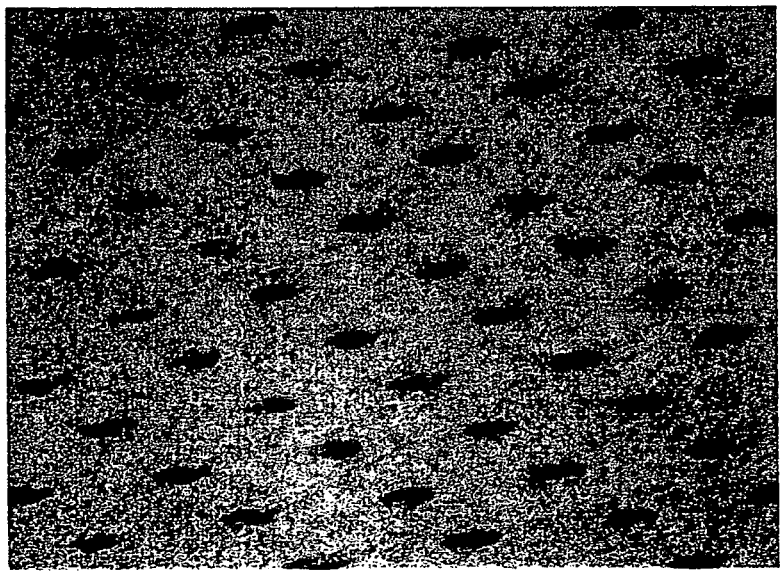
FIG. 3B the impressions which would be formed by the forming fabric surface shown in FIG. 2B.
Figure 4A:
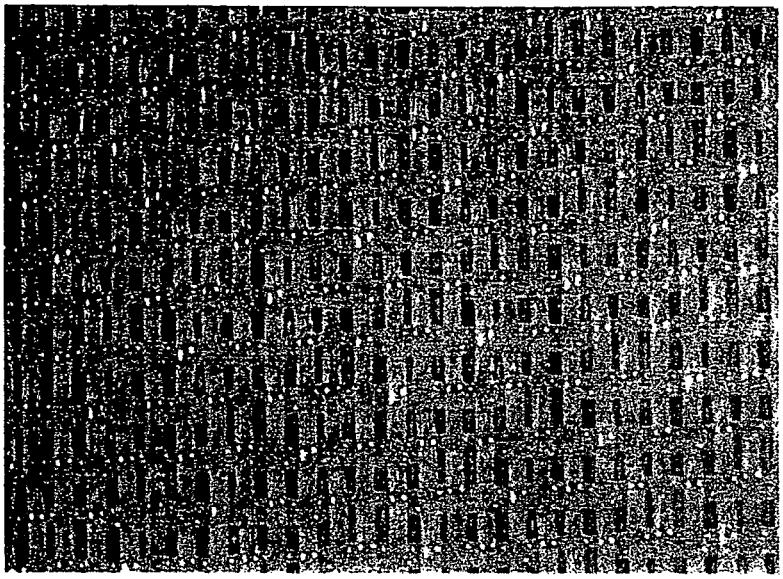
FIG. 4A shows a top view of an actual forming fabric having one or more features of the invention and illustrates the weave of the paper side of the forming fabric. This figure uses a 3-over/1-under/3-over binder weave pattern.
Figure 4B:
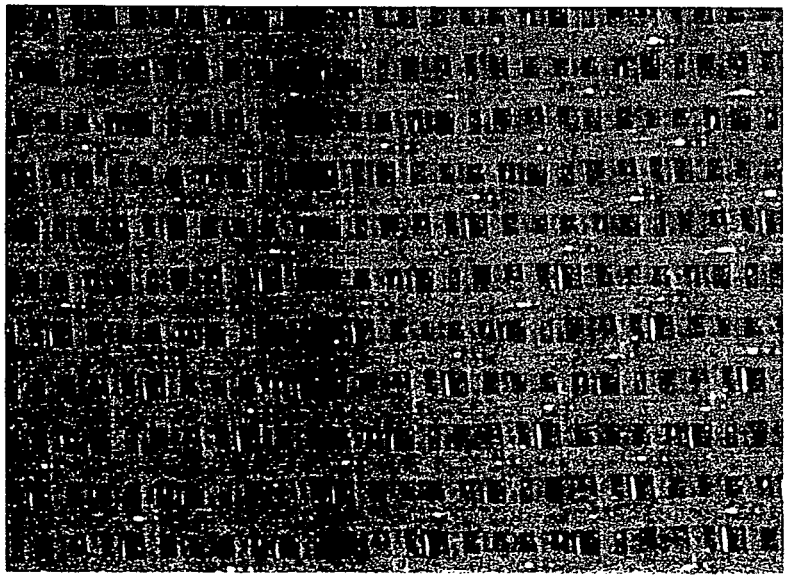
FIG. 4B a bottom view of an actual forming fabric having one or more features of the invention and illustrates the weave of the machine side of the forming fabric shown in FIG. 4A.
Figure 5A:
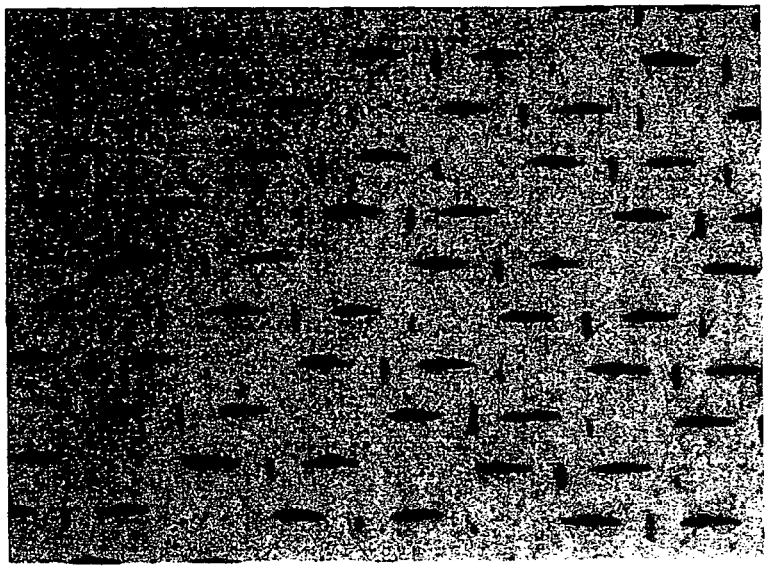
FIG. 5A shows the impressions which would be formed by the forming fabric surface shown in FIG. 4A.
Figure 5B:
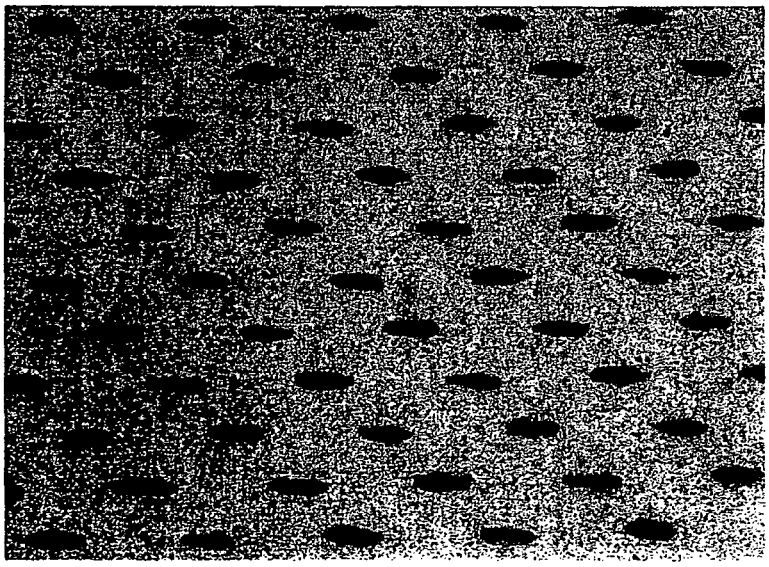
FIG. 5B the impressions which would be formed by the forming fabric surface shown in FIG. 4B.

As seen in FIG. 1N, another single stitching or binding weft yarn 21 passes over upper warp yarns 1 and 3. The stitching or binding weft yarn 21 then crosses to the lower layer by passing under upper warp yarn 5 and then binds with lower warp yarn 8. That is, the binding weft yarn 21 binds only with lower warp yarn 8. Thus, in the area where the stitching or binding weft yarn 21 binds with the lower layer, the binding of the lower layer occurs with a single binding point per repeat. Thereafter, the stitching or binding weft yarn 21 crosses back over to the upper layer by passing underneath upper warp yarn 9 before weaving with other upper warp yarns by passing or floating over upper warp yarns 11 and 13, then passing under upper warp yarns 15 and 17, and then passing over upper warp yarn 19.

As seen in FIG. 1O, an upper weft yarn 22 that weaves exclusively with the top layer warp yarns 1, 3, 5, 7, 9, 11, 13, 15, 17 and 19 to form a plain weave.

Also seen in FIG. 1O, a lower weft yarn 23 weaves exclusively with the bottom layer warp yarns 2, 4, 6, 8, 10, 12, 14, 16, 18 and 20 to form a pattern which follows the following course: lower weft yarn 23 passes or floats under lower warp yarns 2, 4, 6 and 8, then passes over warp yarn 10, then passes or floats under lower warp yarns 12, 14, 16 and 18, and then passes over warp yarn 20.

As seen in FIG. 1P, a single stitching or binding weft yarn 24 binds with lower warp yarn 2. That is, the binding weft yarn 24 binds only with lower warp yarn 2. Thus, in the area where the stitching or binding weft yarn 24 binds with the lower layer, the binding of the lower layer occurs with a single binding point per repeat. Thereafter, the stitching or binding weft yarn 24 crosses over to the upper layer by passing underneath upper warp yarn 3 before weaving with other upper warp yarns. The stitching or binding weft yarn 24 passes or floats over upper warp yarns 5 and 7, then passes under upper warp yarns 9 and 11, then passes or floats over upper warp yarns 13, 15 and 17, and then begins to cross back to the lower layer in the next repeat.

As seen in FIG. 1Q, another upper weft yarn 25 that weaves exclusively with the top layer warp yarns 1, 3, 5, 7, 9, 11, 13, 15, 17 and 19 to form a plain weave.

Also seen in FIG. 1Q, another lower weft yarn 26 weaves exclusively with the bottom layer warp yarns 2, 4, 6, 8, 10, 12, 14, 16, 18 and 20 to form a pattern which follows the following course: lower weft yarn 26 passes under lower warp yarn 2, then over lower warp yarn 4, and then passes or floats under lower warp yarns 6, 8, 10 and 12, then passes over lower warp yarn 14. Thereafter, lower weft yarn 26 passes or floats under lower warp yarns 16, 18 and 20.

As seen in FIG. 1R, another single stitching or binding weft yarn 27 passes over upper warp yarn 1. The stitching or binding weft yarn 27 then passes under upper warp yarns 3 and 5. The stitching or binding weft yarn 27 then passes or floats over upper warp yarns 7, 9 and 11, and then crosses to the lower layer by passing under upper warp yarn 13 and then binds with lower warp yarn 16. That is, the binding weft yarn 27 binds only with lower warp yarn 16. Thus, in the area where the stitching or binding weft yarn 27 binds with the lower layer, the binding of the lower layer occurs with a single binding point per repeat. Thereafter, the stitching or binding weft yarn 27 crosses back over to the upper layer by passing underneath upper warp yarn 17 before weaving with other upper warp yarns by passing over upper warp yarn 19.

As seen in FIG. 1S, another upper weft yarn 28 that weaves exclusively with the top layer warp yarns 1, 3, 5, 7, 9, 11, 13, 15, 17 and 19 to form a plain weave.

Also seen in FIG. 1S, another lower weft yarn 29 weaves exclusively with the bottom layer warp yarns 2, 4, 6, 8, 10, 12, 14, 16, 18 and 20 to form a pattern which follows the following course: lower weft yarn 29 passes or floats under lower warp yarns 2, 4 and 6, then passes over warp yarn 8, then passes or floats under lower warp yarns 10, 12, 14 and 16, then passes over lower warp yarn 18, and then passes under lower warp yarn 20.

As seen in FIG. 1T, another single stitching or binding weft yarn 30 passes or floats over upper warp yarns 1, 3 and 5. The stitching or binding weft yarn 30 then crosses to the lower layer by passing under upper warp yarn 7 and then binds with lower warp yarn 10. That is, the binding weft yarn 30 binds only with lower warp yarn 10. Thus, in the area where the stitching or binding weft yarn 30 binds with the lower layer, the binding of the lower layer occurs with a single binding point per repeat. Thereafter, the stitching or binding weft yarn 30 crosses back over to the upper layer by passing underneath upper warp yarn 11 before weaving with other upper warp yarns by passing or floating over upper warp yarns 13 and 15, and then passes under upper warp yarns 17 and 19.

By way of non-limiting example, the top layer warp yarns 1, 3, 5, 7, 9, 11, 13, 15, 17 and 19 of the embodiment shown in FIGS. 1-1T can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.20 mm. The material for these yarns can be any natural or synthetic material, is preferably a synthetic monofilament, and is most preferably a polyester monofilament.

By way of non-limiting example, the bottom layer warp yarns 2, 4, 6, 8, 10, 12, 14, 16, 18 and 20 of the embodiment shown in FIGS. 1-1T can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, is preferably a synthetic monofilament, and is most preferably a polyester monofilament. The bottom warp yarns can preferably be constructed using relatively large diameter yarns that are well suited to sustain the wear caused by the friction between the machine side surface of the fabric and the papermaking machine during use of the fabric.

By way of non-limiting example, the upper weft yarns 1, 4, 7, 10, 13, 16, 19, 22, 25 and 28 of the embodiment shown in FIGS. 1-1T can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.80 mm. The material for these yarns can be any natural or synthetic material, is preferably a synthetic monofilament, and is most preferably a polyester monofilament.

By way of non-limiting example, the lower weft yarns 2, 5, 8, 11, 14, 17, 20, 23, 26 and 29 of the embodiment shown in FIGS. 1-1T can have the following characteristics: acceptable size range of between approximately 0.15 mm and approximately 0.60 mm, preferable size ranges of between approximately 0.20 mm and approximately 0.40 mm, and most preferred size range of between approximately 0.25 mm and approximately 0.35 mm. The material for these yarns can be any natural or synthetic material, is preferably a synthetic monofilament, and is most preferably a polyester monofilament. These bottom weft yarns may also be constructed using larger diameter yarns than the upper warp yarns.

By way of non-limiting example, the stitching or binding weft yarns 3, 6, 9, 12, 15, 18, 21, 24, 27 and 30 of the embodiment shown in FIGS. 1-1T can have the following characteristics: acceptable size range of between approximately 0.10 mm and approximately 0.50 mm, preferable size ranges of between approximately 0.20 mm and approximately 0.80 mm, and most preferred size range of between approximately 0.12 mm and approximately 0.20 mm. size range of between approximately 0.25 mm and approximately 0.35 mm. The material for these yarns can be any natural or synthetic material, is preferably a synthetic monofilament, and is most preferably a polyester monofilament. These binder weft yarns may also preferably be constructed using larger diameter yarns than the upper weft yarns.

In the embodiment shown in FIGS. 1-1T, only 33% of the weft yarns (i.e., 10 out of the 30 warp yarns in each repeat of the fabric) weave in both the top fabric layer and the bottom fabric layer. The stacked weft yarn arrangement (with the exception of the binding weft yarns) of fabric can provide straight-through drainage—a desired fabric feature in many papermaking applications—as water reaching the top surface of the top fabric layer meets drainage holes between the yarns that go straight through to the bottom of the bottom fabric layer. Additionally, by having less than 100% of the weft yarns weaving in both the top and bottom fabric layers, it is generally possible to reduce the yarn mass within the fabric, thereby providing a fabric having increased permeability and a higher void volume than an equivalent fabric formed with 100% of the weft yarns configured as stitching yarns. These features are also desirable in numerous papermaking applications.

The invention encompasses a variety of different types of fabrics. For instance, the invention noted herein encompasses fabrics woven with different repeat than that pictured and described above. The fabric can have various top to bottom warp yarn ratios. The invention further contemplates other multilayer fabrics, and not just the "true" triple layer fabrics depicted in the figures.

As noted above, certain embodiments of the present invention are directed to "true" triple layer fabrics—meaning triple layer fabrics that include (1) a set of warp yarns and a set of weft yarns that each weave exclusively in a top fabric layer, (2) a set of warp yarns and a set of weft yarns that each weave exclusively in a bottom fabric layer and (3) stitching weft yarns that stitch the top and bottom fabric layers together. Pursuant to the teachings of the present invention, it will be appreciated that the weft-stitched true triple layer fabrics may have improved stacking, increased permeability and higher fiber support as compared to double layer fabrics. Additionally, by using stitching weft yarns that utilize a textured weave, the papermaking surface will be able to impart impressions to the paper. The fabric also advantageously has a large number of drainage openings.

Those of skill in the art will likewise appreciate that the stitching weft yarns need not be included between every adjacent pair of top weft yarns. Instead, a stitching weft yarn may be provided after every second, third, fourth or fifth top weft yarn. Additionally, the top weft yarns themselves could be replaced by stitching weft yarn pairs in certain embodiments of the present invention. Those of skill in the art will also appreciate that the frequency of interlacing can be varied from that shown in the fabrics pictured herein. However, the stitching weft yarns should sufficiently bind the upper and lower fabric layers together to prevent excessive movement between the fabric layers, as such excessive movement could result in inter-layer wear problems.

The fabrics pictured and otherwise described and claimed herein may be employed in a variety of applications, including board and packaging grades.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the triple layer fabrics disclosed herein, preferably the diameter of the top weft yarns, the top warp yarns and the stitching weft yarns is between about 0.10 and 0.22 mm, the diameter of the bottom warp yarns is between about 0.14 and 0.27 mm, and the diameter of the bottom weft yarns is between about 0.18 and 0.50 mm. Those of skill in the art will appreciate that yarns having diameters outside the above ranges may be used in certain applications. In one embodiment of the present invention, the top weft yarns, the top warp yarns and the stitching weft yarns have diameters of about 0.13 mm, and the diameter of the bottom warp yarns is about 0.17 mm. In this embodiment the diameter of the bottom weft yarns is between about 0.33 and 0.36 mm. The total top finished end count on this fabric is 34 ends per centimeter. Fabrics employing these yarn sizes may be implemented with polyester yarns or with a combination of polyester and nylon yarns.

The fabrics of the present invention have been described herein are flat woven fabrics and hence the warp yarns for these fabrics run in the machine direction (a direction aligned with the direction of travel of the papermakers' fabric on the papermaking machine) when the fabric is used on a papermaking machine and the weft yarns for these fabrics run in the cross machine direction (a direction parallel to the fabric surface and traverse to the direction of travel) when the fabric is used on a papermaking machine. However, those of skill in the art will appreciate that the fabrics of the present invention could also be woven using an endless weaving process. If such endless weaving were used, the warp yarns would run in the cross machine direction and the weft yarns would run in the machine direction when the fabric was used on a papermaking machine.

Pursuant to another aspect of the present invention, methods of making triple layer papermaker's fabrics are provided. Pursuant to these methods, the fabrics are woven using three separate warp beams. Weft yarns that weave exclusively in the top fabric layer are provided off of the first weft beam. Weft yarns that weave exclusively in the bottom fabric layer are woven off of the second weft beam. Weft yarns that weave in both the top and bottom fabric layers are woven off of the third beam. The weft yarns on the second beam preferably have a larger diameter than the weft yarns woven off the first beam. Additionally, the weft yarns woven off the third beam may differ from the weft yarns woven off both the first and second warp beams, e.g., they might have a lower modulus of elasticity.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A forming fabric comprising:

a top layer comprising a plurality of top warp yarns woven with a plurality of top weft yarns;

a bottom layer comprising a plurality of bottom warp yarns woven with a plurality of bottom weft yarns;

a plurality of intrinsic binding yarns; and at least one of the intrinsic binding yarns being woven with some of the top layer yarns and binding with one of the bottom layer yarns in each repeat, wherein the top and bottom layers are bound only with single intrinsic and not paired binding yarns.

2. The fabric of claim 1, wherein the plurality of intrinsic binding yarns are binding weft yarns weaving to in the top layer with a different weave pattern than the plurality of top weft yarns.

3. The fabric of claim 1, wherein the plurality of intrinsic binding yarns are binding warp yarns weaving to in the top layer with a different weave pattern than the plurality of top warp yarns.

4. The fabric of claim 1, wherein the plurality of intrinsic binding yarns weave to in top layer with a different weave pattern than the plurality of top weft yarns and the plurality of top warp yarns.

5. The fabric of claim 1, wherein the forming fabric is a weft-stitched triple layer papermaker's fabric.

6. The fabric of claim 1, wherein the forming fabric is a warp-stitched triple layer papermaker's fabric.

7. The fabric of claim 1, wherein the top layer has a papermaking surface and the bottom has a machine side surface.

8. The fabric of claim 1, wherein the plurality of weft yarns in the top layer weave to the top layer warp yarns with a plain weave.

9. The fabric of claim 1, wherein each of the plurality of top warp yarns weaves to the top layer with a plain weave.

10. The fabric of claim 1, wherein the at least one of the intrinsic binding yarn binds with only one of the bottom layer yarns in each repeat.

11. The fabric of claim 1, wherein the at least one of the intrinsic binding yarn binds with only one of the plurality of the bottom layer warp yarns in each repeat.

12. The fabric of claim 1, wherein each intrinsic binding yarn binds with only one of the plurality of the bottom layer warp yarns in each repeat.

13. The fabric of claim 1, the plurality of top warp yarns and the plurality of bottom warp yarns are vertically stacked.

14. The fabric of claim 1, wherein the intrinsic binding yarns differ from the plurality of the top layer warp and weft yarns in at least one of the following characteristics:

size;

modulus;

material.

15. The fabric of claim 1, wherein at least one of the plurality of top warp yarns differ from at least one of the plurality of bottom warp yarns in at least one of the following characteristics:

size;

modulus;

material.

16. The fabric of claim 1, wherein the at least one of the plurality of top weft yarns differs from the at least one of the plurality of bottom weft yarns in at least one of the following characteristics:

size;

modulus;

material.

17. The fabric of claim 1, wherein at least one of the plurality of top warp yarns is smaller in size than at least one of the plurality of bottom warp yarns.

18. The fabric of claim 1, wherein the top layer weft and warp yarns are woven with a plain weave and wherein the intrinsic binding yarns weave in the top layer with a textured weave pattern.

19. The fabric of claim 1, wherein the top layer weft and warp yarns are woven with a plain weave and wherein the intrinsic binding yarns are binding weft yarns which weave with top layer warp yarns with a textured weave pattern.

20. The fabric of claim 1, wherein the top layer weft and warp yarns are woven with a plain weave and wherein the intrinsic binding yarns are binding warp yarns which weave with top layer weft yarns with a textured weave pattern.

21. The fabric of claim 1, wherein the intrinsic binding yarns are structured and arranged to impart a disturbed and/or a textured surface onto paper by floating over crossing upper layer yarns with 2-over/2-under/3-over weave.

22. The fabric of claim 1, wherein the intrinsic binding yarns are structured and arranged to impart a disturbed and/or a textured surface onto paper by floating over crossing upper layer yarns with 3-over/1-under/3-over weave.

23. The fabric of claim 1, wherein the intrinsic binding yarns are structured and arranged to extend above a main paper side surface of the fabric so as to impart surface impressions into a surface of paper.

24. The fabric of claim 1, wherein every other pick is a single intrinsic binding yarn which weaves with some of the top layer yarns and binds with one of the bottom layer yarns in each repeat.

25. A forming fabric comprising:

a top layer comprising a plurality of top warp yarns woven with a plurality of top weft yarns;

a bottom layer comprising a plurality of bottom warp yarns woven with a plurality of bottom weft yarns;

a plurality of binding weft yarns; and at least one of the binding weft yarns being woven with some of the top layer yarns and binding with only one of the bottom layer yarns in each repeat, wherein the top and bottom layers are bound with single intrinsic and not paired binding yarns and not vertically stacked pairs of intrinsic binding yarns.

26. The fabric of claim 25, wherein the plurality of binding weft yarns are intrinsic binding weft yarns that weave to in the top layer with a different weave pattern than the plurality of top weft yarns.

27. A forming fabric comprising:

a top layer composed of a plurality of top warp yarns woven with a plurality of top weft yarns; and a bottom layer composed of a plurality of bottom warp yarns woven with a plurality of bottom weft yarns, wherein the top layer is bound to the bottom layer only with single alternating and not paired binding yarns which weave with some of the top layer yarns and bind with one of the bottom layer yarns in each repeat.

28. The fabric of claim 27, wherein the single binding yarns are single binding weft yarns which weave with some of the top layer warp yarns and bind with one of the bottom layer warp yarns in each repeat.

29. The fabric of claim 27, wherein the single binding yarns are intrinsic binding weft yarns which weave to in the top layer with a different weave pattern than the plurality of top weft yarns.

30. A method of making the fabric of claim 27, comprising:

binding together the top and bottom layers with the single binding yarns.

31. A method of making the fabric of claim 1, comprising:

weaving together the top and bottom layers with the at least one of the plurality of intrinsic binding yarns.

32. A method of making the fabric of claim 25, comprising:

weaving together the top and bottom layers with the at least one of the plurality of binding weft yarns.

* * * * *